US006883823B2

(12) United States Patent
Riepler et al.

(10) Patent No.: US 6,883,823 B2
(45) Date of Patent: Apr. 26, 2005

(54) STIFFENING AND/OR DAMPING ELEMENT FOR A SLIDING DEVICE, ESPECIALLY FOR A SKI OR SNOWBOARD

(75) Inventors: Bernhard Riepler, Wagrain (AT); Helmut Holzer, Wagrain (AT); Rupert Huber, Radstadt (AT)

(73) Assignee: Atomic Austria GmbH, Altenmarkt im Pongau (AT)

( * ) Notice: Subject to any disclaimer, the term of this patent is extended or adjusted under 35 U.S.C. 154(b) by 92 days.

(21) Appl. No.: 10/297,109

(22) PCT Filed: May 15, 2001

(86) PCT No.: PCT/AT01/00139

§ 371 (c)(1),
(2), (4) Date: Nov. 29, 2002

(87) PCT Pub. No.: WO01/91861

PCT Pub. Date: Dec. 6, 2001

(65) Prior Publication Data

US 2004/0100067 A1 May 27, 2004

(30) Foreign Application Priority Data

Jun. 2, 2000 (AT) ..... A 968/2000

(51) Int. Cl.[7] ..... A63C 5/07

(52) U.S. Cl. ..... 280/602; 280/11.14; 280/617

(58) Field of Search ..... 280/601, 602, 280/607, 608, 609, 610, 11.14, 611, 616, 617, 636, 14.22

(56) References Cited

U.S. PATENT DOCUMENTS

| | | | | |
|---|---|---|---|---|
| 3,270,111 A | | 8/1966 | Haldemann | |
| 4,300,786 A | * | 11/1981 | Alley | 280/602 |
| 5,046,751 A | * | 9/1991 | Scherubl | 280/607 |
| 5,301,965 A | * | 4/1994 | Floreani | 280/600 |
| 5,301,976 A | * | 4/1994 | Stepanek et al. | 280/602 |
| 5,332,252 A | * | 7/1994 | Le Masson et al. | 280/602 |
| 5,421,602 A | * | 6/1995 | Stepanek et al. | 280/602 |
| 5,441,296 A | * | 8/1995 | Phelipon et al. | 280/602 |
| 5,464,242 A | * | 11/1995 | Commier et al. | 280/602 |
| 5,465,994 A | * | 11/1995 | Commier et al. | 280/602 |
| 5,470,094 A | * | 11/1995 | Commier et al. | 280/602 |
| 5,480,175 A | * | 1/1996 | Astier et al. | 280/607 |
| 5,597,170 A | * | 1/1997 | Le Masson et al. | 280/602 |
| 5,678,840 A | * | 10/1997 | Simonian | 280/602 |
| 5,775,716 A | * | 7/1998 | Harsanyi et al. | 280/602 |
| 5,779,257 A | * | 7/1998 | Bonvallet et al. | 280/602 |
| 5,803,479 A | * | 9/1998 | Meyer et al. | 280/607 |
| 5,806,875 A | * | 9/1998 | Bonvallet | 280/602 |
| 5,944,335 A | | 8/1999 | Riepler | |
| 6,158,747 A | * | 12/2000 | Magnani | 280/11.14 |
| 6,193,262 B1 | * | 2/2001 | Silva | 280/607 |
| 6,604,754 B1 | * | 8/2003 | Gyr | 280/602 |

FOREIGN PATENT DOCUMENTS

| | | |
|---|---|---|
| AT | 317 733 | 5/1970 |
| DE | 19 61 487 | 7/1970 |
| DE | 25 55 497 | 6/1976 |
| DE | 29 43 850 | 12/1980 |
| DE | 87 01 008 | 3/1987 |
| DE | 40 23 644 | 7/1991 |
| DE | 43 40 662 | 1/1995 |
| EP | 0 730 890 | 9/1996 |
| WO | WO 94/19175 | 9/1994 |
| WO | WO 94/28984 | 12/1994 |

* cited by examiner

*Primary Examiner*—Christopher P. Ellis
*Assistant Examiner*—Jeff Restifo
(74) *Attorney, Agent, or Firm*—Collard & Roe, P.C.

(57) ABSTRACT

A runner device (1), in particular a ski (2), snowboard, runner or similar, with a stiffening and/or damping element (50) joined to at least one part of the runner device (1), e.g. a layer or an inlaid element, the stiffening and/or damping element (50) being formed by a casing element (46) forming a housing compartment (45) filled with packers (44), which can be adjusted in terms of its hardness or its deformation resistance as necessary by reducing an internal pressure to a pressure below atmospheric pressure.

37 Claims, 9 Drawing Sheets

STIFFENING AND/OR DAMPING ELEMENT FOR A SLIDING DEVICE, ESPECIALLY FOR A SKI OR SNOWBOARD

BACKGROUND OF THE INVENTION

Field of the Invention

The invention relates to a runner device.

SUMMARY OF THE INVENTION

The underlying objective of the invention is to propose a system that will enable the deformation behaviour or hardness of the runner device to be rapidly changed or adapted to different conditions of use, particularly to cope with hard or soft, prepared and/or non-prepared pistes.

This objective is achieved with a runner device comprising a stiffening and/or damping element extending over at least a portion of the length and width of the runner device for absorbing and counterbalancing external forces to which the running device may be subjected. The stiffening and/or damping element consists of an elastically deformable casing element formed by at least one covering layer, the casing element enclosing a housing compartment having an evacuatable interior chamber which is filled with filler bodies and has a vent. An evacuation mechanism is connected by a supply line the vent for changing the air pressure in the interior chamber whereby the hardness and resistance to deformation of the stiffening and/or damping element is adjustable. Such a runner device, in particular a ski or snowboard, permits a rapid change or adaptation to specific conditions of use, due to the fact that the properties, in particular the deformation resistance and/or the hardness can be quickly and easily varied. This is primarily made possible due to a stiffening or damping element provided in the runner device and if one or more of these elements are provided, the rigidity of the runner device can be varied across all or part of the cross-section. Elastically resilient packers embedded in a casing element are provided in order to afford a damping action in a first, initial state and a second state can be obtained in order to impart a stiffening element to the runner device if necessary, by evacuating the housing compartment to below atmospheric pressure. This produces an exact edge grip, a harmonious change in tension, good damping properties perpendicular to the running face or top face of the runner device in the event of impact and good deformation properties when turning corners.

Such a stiffening and/or damping element provides a component made from simple, standardised and inexpensive individual components capable of fulfilling a plurality of functions, which enables the travel behaviour of a runner device to be selectively influenced.

Also of advantage is an embodiment wherein the runner device comprises more than one stiffening and/or damping element spaced apart from one another in the longitudinal direction and/or in a direction disposed transversely thereto and/or in a direction of a thickness since it provides a means of adjusting some aspects of the hardness or deformation properties if necessary, which in turn influences the running properties.

The casing element may have several covering layers with differing elasticities, compensating for the clearance between individual components, especially in the evacuated state.

A specifically selected quantity of filler bodies can be uniformly distributed throughout the volume of the casing element or housing compartment in the evacuated state if the housing compartment has several part-components separated by elastically deformable webs or housing compartments of several casing elements or part-compartments thereof are in flow communication.

Casing elements disposed in a reinforcing element impart a high degree of strength to the runner device, in particular a high tensile and/or compression and/or bending strength.

If the casing element has one or more reinforcing elements in the housing compartment, the deformation resistance of the runner device is enhanced still further.

The embodiments wherein the casing element is disposed between two or more layers or coverings of a multi-layered runner device have proved to be of particular advantage because the stiffening and/or damping elements can be arranged so that they are assigned to individual part-regions of the runner device, depending on the type of application.

The housing compartment preferably is in flow communication with the evacuating mechanism via a return valve, and the runner device has a connector fitting for an external vacuum pump. This provides an easy means of evacuating the housing compartment in the casing element, thereby reducing the internal pressure relative to the ambient pressure, using a standardised and inexpensive evacuating means, which may be detachable retained on the runner device, for example, or using an external service system.

Another embodiment, wherein at least one mechanism having at least one stiffening and/or damping element co-operating therewith is disposed in the longitudinal direction and/or in a direction disposed transversely thereto on a layer forming the top face of the runner device, also offers advantages, especially as the forces acting on the runner device, for example traction or compression forces, can be better absorbed in the outer peripheral region of the runner device, enabling the running behaviour, in particular the hardness or deformation resistance, to be better adjusted or adapted to different conditions.

If this mechanism has at least one strip-shaped or square or profiled transmitting element forming a supporting element, standardised, inexpensive products may be used.

If the profiled transmitting element is a hollow section with a rounded or oval or polygonal cross section, standardised, inexpensive mass-produced products may be used for the transmitting element, which makes the design of the runner device cost-effective. Cross-sectional shapes of this type have a section modulus which enhances bending stiffness.

In an advantageous embodiment at least one thrust bearing is arranged at a distance apart from a mounting plate for at least one binding part or from a separate fixing mechanism, and the transmitting element extends between them. This has the advantage that the facing or covering on a part-region of the sliding device enables the running behaviour to be influenced more effectively.

Advantageously, an end-side region of the transmitting element is held in position on the mounting plate or the fixing mechanism and the other end-side region is mounted so as to be displaceable relative to the thrust bearing. Such a runner device can be selectively influenced to impart a predeterminable running behaviour, particularly with regard to its hardness and/or deformation resistance.

The transmitting element may be made up of several supporting elements engaging one inside the other or overlapping with one another at least in certain regions, of which an outer hollow section is held in position at its two opposing ends region by the mounting plate or the fixing mechanism and the thrust bearing, whilst an inner of the supporting elements is held in position by the thrust bearing, and at one of the end regions of the transmitting element a cavity is formed by the supporting elements engaging in one another and/or a wall of the thrust bearing or the mounting plate or the fixing mechanism, in which the housing compartments of stiffening and/or damping elements are disposed. Thus, blocks having different properties can be used in the casing elements enabling different running properties to be obtained over several part-regions or cross-sectional regions of the runner device. This offers a significant advantage in that it provides an embodiment of the runner device which saves on space and is structurally resistant to bending and twisting.

Also of advantage are embodiments wherein at least one other transmitting element, which may optionally be joined to the top face, is provided between the mounting plate or a separate fixing mechanism and the thrust bearing spaced at a distance therefrom, and wherein the stiffening and/or damping element is disposed between mutually facing end-side end regions of the transmitting element. This enables shortening the distance between fixing points of the transmitting element extending in between means so that higher loads can be absorbed.

The transmitting elements or supporting elements may optionally be longer than the distance which they span to obtain a pre-tensioning, and as a result always abut with and are supported on the casing element and reinforcing and/or damping element arranged between the two transmitting elements disposed one behind the other, which further enhances the damping or stiffening effect.

The runner device may comprise a thrust bearing and/or a transmitting element having a recess to accommodate at least one stiffening and/or damping element, and the end region of a supporting element projecting into the recess is guided in a longitudinally sliding or pivoting arrangement by a guide mechanism formed by the thrust bearing. This enables the casing element or the stiffening and/or damping element to be accurately positioned in the thrust bearing or in the other transmitting element, thereby affording the option of dispensing with layers of adhesive between the covering of the casing element and the surface of the other part to be joined to it.

If one end of the transmitting element has a substantially strip-shaped plate element adjoining the housing compartment of the stiffening and/or damping element, the attack surface of the plate element engaging with the casing element or stiffening and/or damping element is enlarged, so that the loads or forces acting on the runner device are distributed in a planar arrangement across a wide region of the device.

The recess in the thrust bearing or in the transition element may be divided into several compartments, permitting a relative displacement between the supporting element and the thrust bearing or the transmitting element when subjected to loads.

BRIEF DESCRIPTION OF THE DRAWING

The invention will be described in more detail below with reference to examples of embodiments illustrated in the appended drawings.

Of these.

DESCRIPTION OF THE PREFERRED EMBODIMENTS

Figure 1:
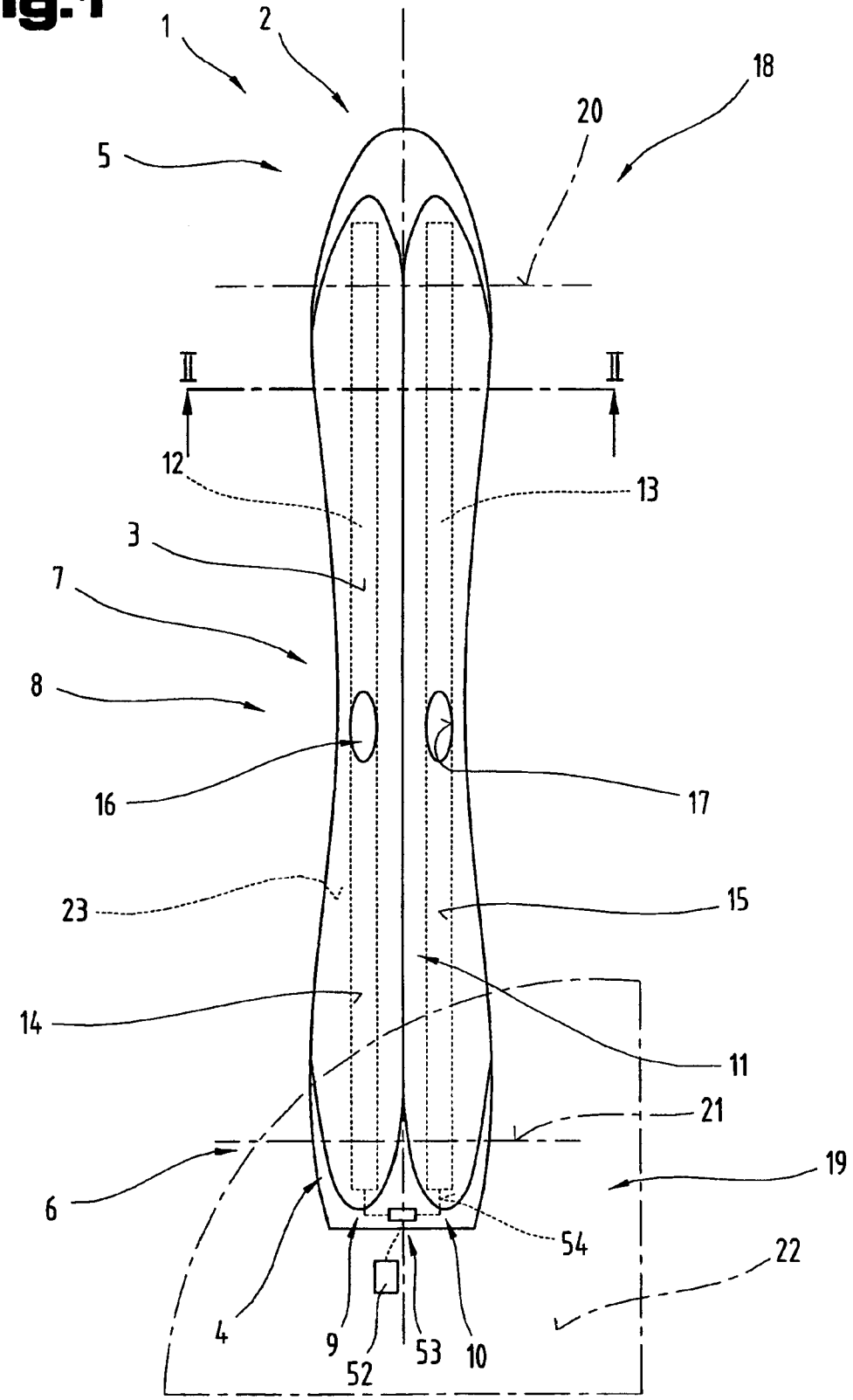
FIG. 1 is a simplified diagram in plan view, illustrating the runner device proposed by the invention, not to scale, having a profiled top face.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc,. relate to the drawing specifically being described and can be transposed in terms of meaning to a new position when another position is being described. Individual features or combinations of features from the different embodiments illustrated and described may be construed as independent inventive solutions or solutions proposed by the invention in their own right.

Figure 2:
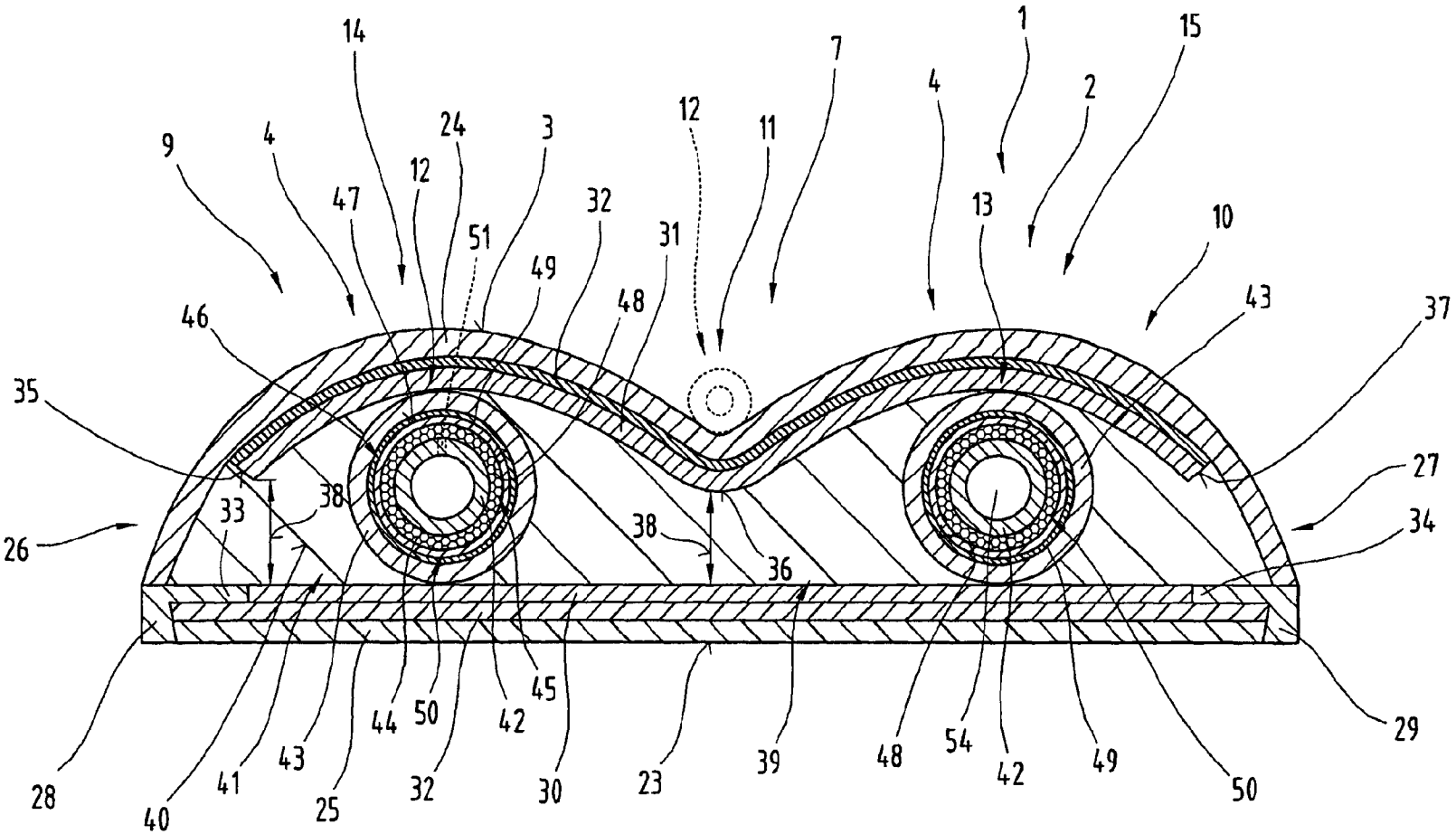
FIG. 2 shows a cross section of the runner device illustrated in FIG. 1 incorporating the stiffening and/or damping element proposed by the invention, viewed along line II—II indicated in FIG. 1.

FIGS. 1 and 2, which will be described together, provide a plan view and a view in section of a runner device 1 of the design and structure proposed by the invention. Depending primarily on the selected ratio of length to width, this runner device 1 might be a ski 2 or alternatively a snowboard or a runner. Compared with a so-called snowboard, a ski 2 will have a bigger length-to-width ratio.

A top face 3 of the runner device 1, as seen in plan view or from the position in which it is used—illustrated in FIG. 1—is preferably of a profiled or contoured design. A profiled region 4 extends continuously across almost the entire length until just short of the end regions 5, 6 of the runner device 1. Optionally, the profiled region 4 may extend in a middle region 7 of the runner device 1 and in a binding mounting region 8 thereof and merge with the planar middle region 7 which is used as a mounting platform for an appropriate binding. Starting from an optionally planar, plateau-type middle region 7, the profiled region 4 extends across the top face 3 of the runner device 1 and in any case to just short of the end regions 5, 6. The profiled region 4 is more pronounced in the middle region 7 and in the regions adjoining the binding mounting region 8 than in the end regions 5, 6 of the runner device 1. In particular, the profiled region 4 becomes gradually wider, the closer it is to the two end regions 5, 6 of the runner device 1. In other words, the profiled region 4 becomes continuously flatter, the closer it is to the end regions 5, 6 and finally merges with planar end regions 5, 6. At least one so-called toe of the runner device 1 is provided in the end regions 5, 6.

The profiled region 4 on the top face 3 is provided in the form of at least one, preferably two cambered strips 9, 10 running substantially parallel with one another. Alternatively, three or more such strips 9, 10 could be provided, extending in the longitudinal direction of the runner device 1.

Extending in the longitudinal direction of the runner device 1 between two strips 9, 10 is a recess 11, which may be pronounced to a greater or lesser degree. The base or bottom of the recess 11 may be substantially V-shaped or alternatively U-shaped in cross section, i.e. with a substantially flattened, planar bottom. Instead of a cambered profiled a region 4 which would have at least one-bow-shaped raised area on the top face 3 of the runner device 1 if viewed transversely to the longitudinal direction, it would naturally also be possible to used profiled regions 4 of differing shapes. For example, it would also be possible to provide a flat area in the region of the apex of the cambered strips 9, 10, which would result in strips 9, 10 of a trapezoidal shape in cross section. Another option would be to reverse the contours of the recess 1 and the strips 9, 10, in which case a cambered strip would run down the middle region of the runner device 1 with two channel-shaped recesses in the top face 3 of the runner device 1 on either side of the cambered strip.

The multi-layered body of the runner device 1 contains at least one reinforcing element 12, 13. By preference, a reinforcing element 12, 13 is provided for each strip 9, 10 or each raised area 14, 15. The reinforcing elements 12, 13 are preferably also fully integrated in the runner device 1, i.e. enclosed on all sides by other components of the runner device 1.

Optionally, it would also be possible to provide the reinforcing element or elements 12, 13 in the middle region 7, for example, or in the binding mounting region 8 or alternatively in the areas adjoining the binding mounting region 8 or so that they extend out from between the multi-layered structure or sandwich element in a region between the middle region 7 and the end regions 5; 6. This being the case, the reinforcing elements 12, 13 may run close to the top face 3 of the runner device 1 and may be at least partially visible by means of transparent part-regions provided in the form of a viewing window 16 or cutouts 17 in the top face 3 of the runner device 1.

A longitudinal extension of the profiled region 4 on the top face 3 of the runner device 1 is only slightly bigger than a longitudinal extension of the integrated reinforcing elements 12, 13. In other words, a length of the reinforcing elements 12, 13 is only slightly smaller than the longitudinal extension of the profiled region 4. The longitudinal dimensions of the integrated reinforcing elements 12, 13 are therefore one of the factors determining the longitudinal extension of the profiled region 4 on the top face 3.

By preference, the reinforcing elements 12, 13 optionally extend continuously between a front contact zone 18 and a rear contact zone 19 of the runner device 1.

In the neutral state when no force is being applied or in the non-operating state, the runner device 1 has an upwardly curving, bow-shaped contour between its contact regions 20, 21.

Due to the so-called pre-tensioning, when the runner device 1 is in a state where no weight is being applied to it, that is to say under its own natural weight, the middle region 7 does not sit on the ground 22. This is due to the so-called pre-tensioning height of the runner device 1, which is defined by the biggest distance between a running surface 23 of the runner device 1 and a flat contact surface under the effect of the natural weight of the runner device 1.

FIG. 2 illustrates one possible structure of the runner device 1 proposed by the invention. This diagram, showing a cross section, specifically illustrates the layered structure and cross-sectional shapes of the individual components or elements of the runner device 1.

In a manner known per se, the outer peripheral regions of the runner device 1 consist of a top layer 24 forming the top face 3 and a running surface facing 25 forming the running surface 23. The top layer 24 covers the top face 3 and optionally also extends over outwardly directed longitudinal side walls 26, 27 of the runner device 1 perpendicular to the running surface 23. The longitudinal side walls 26 and 27 of the runner device 1 may be designed so that they extend in a parallel or convex arrangement in a know manner. Steel edges 28, 29 form the side boundary of the running surface 23. Instead of providing a top layer 24 shaped to provide a shell component made from a single piece which forms the top surface and side walls of the runner device 1 in a mono-coque structure, it would naturally also be possible for the side walls of the runner device to be provided as separate elements.

The profiled top layer 24 is preferably supported at its two longitudinal edges respectively on a steel edge 28; 29 or on a layer of high-strength material lying in between.

Several layers are provided between the top layer 24 and the running surface facing 25, in particular at least one bottom belt 30 laying immediately adjacent to the running surface facing 25 and/or at least one top belt 31 arranged immediately adjacent to the top layer 24. The bottom belt 30 and/or the top belt 31 are made from a high-strength material and, by reference to the cross section of the runner device 1, are positioned close to the peripheral regions of the runner device 1. Consequently, the bottom belt 30 and/or the top belt 31 are amongst the factors which have a significant influence on the stiffness or flexibility of the runner device 1, depending on their spatial position in the runner device 1.

The top belt 31 is adhesively joined to the top layer 24 by a layer of filler or adhesive 32. Likewise, the flat faces of the bottom belt 30 and running surface facing 25 directed towards one another are adhesively joined to one another by means of a filler or adhesive layer 32. As schematically illustrated, the bottom belt 30 may extend between anchoring projections 33, 34 of the steel edges 28, 29 integrated in the runner device 1. Alternatively, it would also be possible for the bottom belt 30, provided in the form of a flat, strip-shaped component, to extend beyond the anchoring projections 33, 34 and terminate flush with the longitudinal side walls 26, 27 of the runner device 1.

By contrast with the largely flat bottom belt 30, the top belt 31 is preferably profiled. By preference, the top belt 31 is moulded so as to have at least one, preferably two raised areas 14, 15 running in its longitudinal direction with a recess 11 lying in between. Viewed in cross section, therefore, the top belt 31 duly formed from a flat workpiece is of a corrugated design. This cross-sectional corrugated design with preferably two raised areas 14, 15 with the recess 11 in between is dimensioned so that bottom longitudinal edges 35 to 37 of the shaped top belt 31 can be arranged at a distance 38 apart from the steel edges 28, 29 and the bottom belt 30. This distance 38 is maintained in order to prevent the profiled top belt 31 from coming into contact with the steel edges 28, 29 or the bottom belt 30.

This distance 38 is primarily determined by a core component 39 of the runner device 1, of which at least one is provided. This distance 38 is also kept largely constant when forces are acting on the top face 3 and/or the running surface 23, with the exception of relatively short permitted compression paths of the runner device 1. The core component 39 is disposed between the supporting belts, in particular between the bottom belt 30 and the top belt 31. Accordingly, the core component 39 keeps the bottom belt 30 spaced apart from the top belt 31 and, in conjunction with the other layers of the overall runner device 1, forms an integral multilayered or sandwich element as a result of filler or adhesive layers 32 disposed in between.

The space left free around the reinforcing elements 12, 13 between the bottom and top belt 30, 31 is filled with a filler material 40, preferably a plastics material with a pore structure. The filler material 40 preferably also has an adhesive action, so that it remains adhered to the adjoining components, thereby imparting a cohesive, integral structure to the multi-part runner device 1.

The filler material 40 may also be used to provide the runner device 1 with an expanded foam core 41. The reinforcing elements 12, 13 and the filler material 40 or expanded foam core 41 constitute the core component 30. The reinforcing elements 12, 13 may be embedded in the filler material 40 or in the expanded foam core 41. The slight elasticity or flexibility of the filler material 40 or expanded foam core 41 is selected so that the runner device 1 will not susceptible to tearing when the runner device 1 is deformed to its maximum.

The reinforcing element or elements 12, 13, which are preferably arranged at the apex of the almost congruently shaped part-region of the top belt 31, are preferably provided in the form of one or more hollow sections 42, 43 and at least one housing compartment 45 filled with packers 44 and at least one casing element 46 enclosing the latter in an airtight or vacuum-tight arrangement. By preference, the hollow sections 42, 43 are of differing cross-sectional dimensions so that the hollow section 42 is enclosed by or contained in the hollow section 43, at least in certain regions. The casing element 46 may be provided in the form of an elastically resilient and deformable covering 47 or film, for example. All materials known from the prior art may be used for the hollow sections 42; 43, such as plastics or metal materials for example. By preference, an internal face 48, directed towards the casing element 46, of the hollow section 43, which may optionally be made from a metal material, or a surface of the hollow section 42 directed towards the hollow section 43 is provided with an elastic covering 49. The hollow sections 42, 43 bound one or more damping elements 50 arranged between them, which extend across a large part of the length of the runner device 1, for example.

Naturally, it would also be possible to provide several reinforcing elements 12; 13 in the expanded foam core 41, disposed one on top of the other and/or one behind the other and/or one adjacent to the other and/or one above the other in the longitudinal extension and/or in a direction running transversely to the runner device 1 between the recess 11 and the longitudinal side wall 26 or longitudinal side wall 27. In the embodiment illustrated as an example here, tubular hollow sections 42, 43 are provided, which have a circular cross section in a plane perpendicular to their longitudinal extension. By reference to individual cross-sectional planes in the longitudinal direction of the runner device 1, therefore, the respective cross-sectional shapes and/or the cross-sectional dimensions of the integrated reinforcing elements 12; 13 are at least more or less adapted to the respective cross-sectional shapes and contouring 4 of the top face 3 of the individual longitudinal portions of the runner device 1. The packers 44 disposed in the reinforcing and/or damping element 50 form a reversible reinforcing and/or damping element 50 adjustable between a first state, in which it assumes the shape of a circular cross section as illustrated in this embodiment, and a second state brought about by reducing an internal pressure in the housing compartment 45 of the casing element 46 if necessary to a pressure below ambient pressure—evacuation—which, in its evacuated state, constitutes a positive force-fit and/or torque-transmitting transition element in conjunction with the reinforcing element 12; 13, at least in certain regions. This enables the stiffness or deformation resistance of the runner device 1 to be increased in individual regions or across wide regions. An inflating and/or deflating bore 51 projecting into the housing compartment 45 of the casing element 46 is in flow communication with an evacuating mechanism 52, not illustrated, which is either detachable or fixed on the runner device 1, so that pressure can be applied to the stiffening and/or damping element 50 by means of a vacuum pump, which is optionally manually operated, which pumps air out of the housing compartment 45, thereby lowering the pressure to a level below atmospheric pressure. The packers 44, which may optionally be elastic in nature, move closer to one another when pressure is applied and are supported against one another, thereby forming a dimensionally stable stiffening and/or damping element 50. Since the housing compartment 45 of the casing element 46 is evacuated, the cross-sectional dimensions of the stiffening and/or damping element 50 forming a substantially annular cross section are reduced slightly, causing a difference between the external face of the covering 47 or film of the casing element 46 directed towards the hollow section 43, which is filled with an elastically resilient covering 49 disposed on the hollow section 43, thus providing mutual support between the individual components. By providing a manually operable back flow valve 53, the rigid or dimensionally stable state of the housing compartment 45 of the casing element 46 can therefore be reversed on inflation via the evacuating mechanism 52, in other words by an adjustment of pressure between the housing compartment 45 and the ambient pressure. A flow connection is provided between the housing compartment 45 and a vacuum pump by means of a supply line 54, for example. The reinforcing element 12 disposed between the bottom face of the top belt 31 and on and optionally directly adjoining the top face of the bottom belt 30 and held in position thereby produces a linear friction fit connection to the top face and/or bottom face in conjunction with the length of reinforcing element 12; 13, obviating the need for additional positioning elements to fix the reinforcing elements 12; 13 during the foam-expanding process and hence when the filler material 40 for the expanded foam core 41 is injected in.

The packers 44 arranged in the housing compartment 45 of the casing element 46 are made from hard materials, for example, such as plastics with a polystyrene base, etc., or from an open-pore expanded foam. The packers 44 are preferably designed in the form of a geometric body, in particular in the shape of a sphere or a cylinder. Naturally, the packers 44 may also be made from a recycled product. For practical purposes, the packers 44 have a core and a jacket encasing it, in which case the core is of a higher rigidity and lower elasticity than a jacket which encloses it, at least in certain regions. In particular, the core is covered with an elastically resilient, deformable material. Naturally, all other designs of packers known from the prior art may also be used to fill the casing element 46 of the stiffening and/or damping element 50.

The casing element 46 may comprise several layers of film, which are joined to one another in a vacuum-tight seal and enclose or form the housing compartment 45.

In a first state, in which atmospheric pressure prevails in the housing compartment 45, some of the forces which occur during travel can be taken up or absorbed by the damping element 50, and with effect from a certain degree of load, are transmitted to the inner hollow section 42. Consequently, in the first state, a damping element 50 designed with a specific damping or deformation property is obtained, which can cope with softer running behaviour. In the first state—initial state—the covering 47 of the casing element 46 adjoins the internal face 48 of the hollow section 43 and the surface of the hollow section 42 and abuts with them at least in certain regions, so that the packers 44 with an elastic element permit a relative movement between the hollow section 43 and the hollow section 42 during load situations and a greater or the whole proportion of energy is absorbed by the packers 44, thereby resulting in a damping property and softer travel behaviour. Applying a pressure below atmospheric pressure by sucking the air out of the housing compartment 45 causes the packers 44 to be mutually supported, thereby forming a stiffening element 50 with a higher deformation resistance. Consequently, in the second state, any relative movement between the hollow sections 42 and 43 of the runner device 1 in the longitudinal direction is prevented and a positive fit is produced between these to a certain extent, which distributes the loads or forces such as occur during travel to be uniformly distributed across the entire cross section, so that the runner device 1 exhibits a high deformation resistance.

In another embodiment, not illustrated, the reinforcing element 12; 13 is arranged at a distance from at least an underside or top face of the top belt 31 or bottom belt 30 and is held in position with the bottom belt 30 or top belt 31 by additional means, at least in certain regions. This prevents any inadmissible sliding of the reinforcing elements 12; 13 when the expanded foam core 41 is being made.

As illustrated by the broken lines in FIG. 2, the runner device 1 may be provided with at least one reinforcing element 12 or 13 on each raised area 14 or 15 and/or in the recess 11 of the top face 3.

Figure 3:
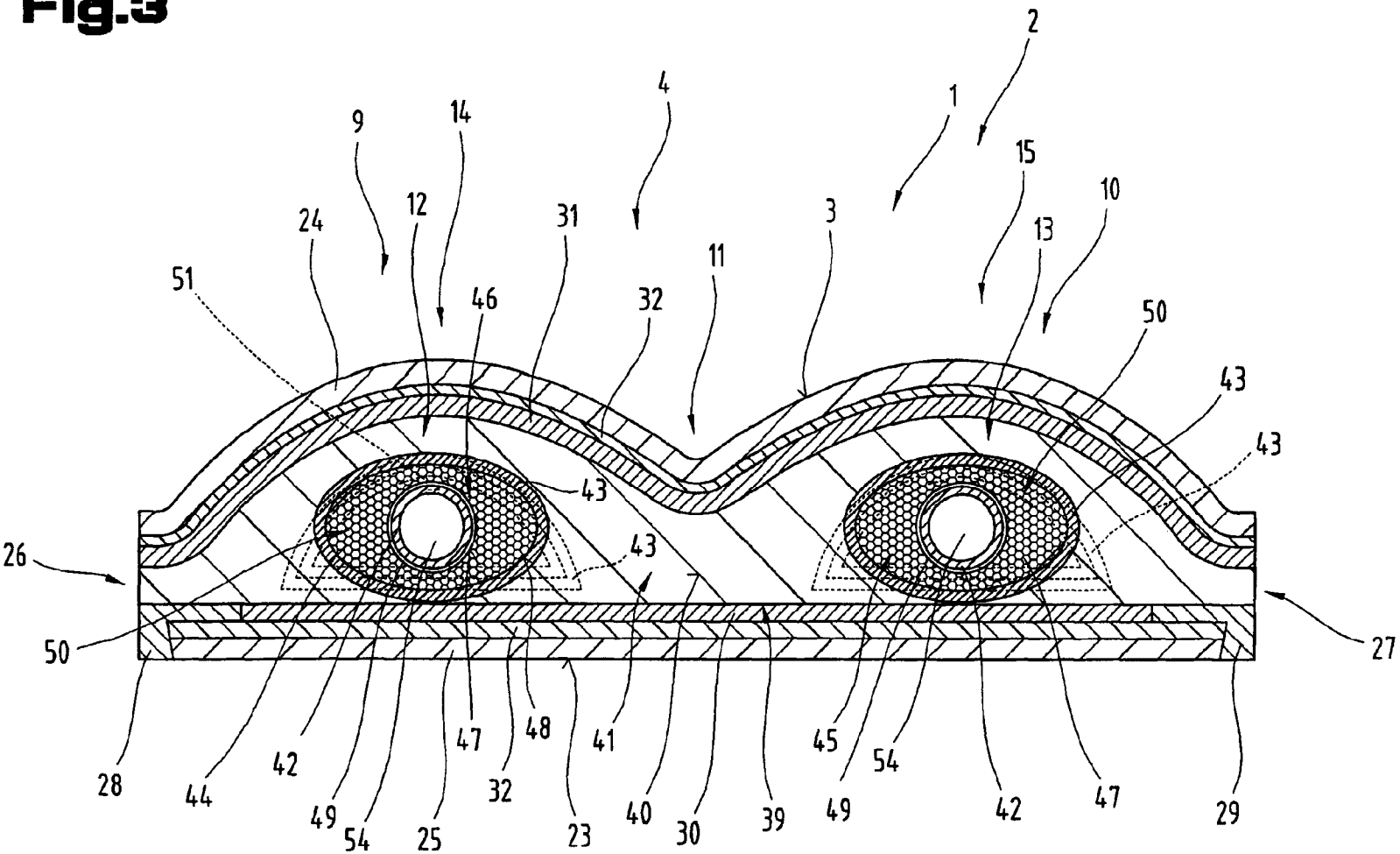
FIG. 3 is a simplified diagram, not to scale, showing a cross section of the stiffening and/or damping element illustrated in FIG. 1.

FIG. 3 illustrates a different embodiment of the structure of a runner device 1 incorporating the reinforcing element 12; 13 and stiffening and/or damping element 50 proposed by the invention, the same reference numbers being used to denote the same parts and the explanations given above being applicable to identical parts with identical reference numbers.

Unlike the embodiment described above, the upper structural elements of the runner device 1 opposing the running surface 23 do not extend above the core component 39 in a shell-type arrangement and instead a relatively narrow part-region of the filler material 40 and expanded foam core 41 may be seen adjoining the longitudinal side walls 26, 27 of the runner device 1. In particular, the upper components of the runner device 1 are angled in a flange-type arrangement at their longitudinal edges facing the steel edges 28, 29 so that the narrow sides of these elements form a part-region of the longitudinal side faces. Consequently, reinforcing elements 12; 13 may be provided in the core component 39 between the recess 11 and the longitudinal side wall 26 and/or the longitudinal side wall 27 and/or in the region of the recess 11 adjacent to the top face 3 of the runner device 1, although this is not illustrated. These reinforcing elements 12; 13 and stiffening and/or damping elements 50, which are elliptical in cross section, are integrated in the runner device 1 so that they lie flat. Preferably, a hollow section 42 with a circular cross section extends across a major part of the length of the runner device 1, arranged at least in certain regions in the longitudinal extension of the hollow section 43 in one or more part-sections of the runner device 1, such as between the middle region 7 and one of the end regions 5 and/or 6 (not illustrated in FIG. 3). The outwardly lying hollow section 43 which overlaps with the hollow section 42, at least in certain regions, has an elliptical or oval cross section in the same cross-sectional plane, a straight line joining the tip regions of the oval hollow section 43 being aligned substantially parallel with the running surface 23 of the runner device 1. The cross-sectional dimensions of the inwardly lying hollow section 42 are significantly smaller than the cross-sectional dimensions of the hollow section 43 encasing it, at least in certain regions, so that the inner hollow section 42 is embedded in the stiffening and/or damping element 50, completely enclosed by it on all sides. The reinforcing element 12; 13 may adjoin the underside of the top belt 31 and/or the top face of the bottom belt 30, as illustrated in this embodiment.

Instead of an elliptical cross section—indicated by broken lines—the outer hollow section 43 may also have a semi-circular or bridge-shaped cross section, in which case the curved part-region will be directed towards the almost congruently shaped top belt 31 and the substantially flat base part will be directed towards the substantially flat bottom belt 30. The advantage of providing the hollow section 43 or optionally the hollow section 42 lying inside it with an elliptical or semi-circular cross section is that they can be adapted to the corrugated contour of the top belt and top face 3 of the runner device 1 over a larger peripheral surface area. Consequently, when the housing compartment 45 is in the evacuated state, a more extensive positive connection is thus obtained between the stiffening and/or damping element 50 and the hollow sections 42, 43 in the casing element 46 and the runner structure is therefore capable of withstanding and absorbing higher shearing forces, tensile forces and twisting.

By preference, at least one of the hollow sections 42; 43, in particular the hollow section 43, is made from an elastically resilient deformable plastics so that a cavity is formed between it and the stiffening and/or damping element 50 in the evacuated state. The casing element 46 and the covering 47 arranged between the hollow sections 42 and 43 enclosing the stiffening and/or damping element 50 in an airtight arrangement abuts with the internal face 48 of the hollow section 43 in the first state—initial state. A surface of the hollow section 42 directed towards the internal face 48 forms a part of the casing element 46 of the stiffening and/or damping element 50. Naturally, a part of the casing element 46 may also be formed by the internal face 48 or surface of the hollow section 42 or the casing element 46 is formed by a covering 47 or films forming an enclosure on all sides, which will be provided as a separate element as such and may be disposed between the hollow sections 12; 13 or directly in the core component 39 if necessary.

In another embodiment, not illustrated, the hollow sections 42, 43 with an elliptical or oval cross section are integrated in the multi-layered body of the runner device 1 with the cross section upstanding. In particular, a straight line linking the tip regions of the oval hollow section 42, 43 runs substantially perpendicular to the running surface 23 of the runner device 1. The reinforcing elements 12; 13 with the stiffening and/or damping element 50 may abut with the underside of the top belt 31 and/or the top face of the bottom belt 30 and/or be spaced apart from them. The housing compartment 45 is evacuated via a supply line 54 and an inflating and/or deflating bore 51 formed by the hollow section 42, dispensing with the complication of having to fit supply lines 54 as a means of generating the vacuum in the housing compartment 45. The hollow sections 42 and/or 43 may naturally be of any cross-sectional shape.

The stiffening and/or damping element 50, which is dimensionally stable in the evacuated state, forms a positive connection with the hollow sections 42, 43, affording high deformation resistance, making it capable of withstanding traction and/or compression and/or shearing forces in particular.

The advantage of this embodiment primarily resides in the fact that an attack surface is formed between the surfaces of the hollow section 42 and the internal face of the hollow section 43 facing one another, which are capable of transmitting high forces or moments.

All materials known from the prior art may be used for the hollow sections 42, 43, such as plastics, glass fibre-reinforced plastics, composite plastics or metal materials, in particular aluminium, titanium or appropriate metal alloys.

Naturally, the supply lines 54 may be arranged in a longitudinal direction or in a direction disposed transversely thereto, linking the reinforcing elements 12; 13 and housing compartments 45 of the stiffening and/or damping elements 50, arranged one above the other and/or one behind the other and/or mutually parallel, to a connecting line accessible from the outside.

In another embodiment, not illustrated, the stiffening and/or damping element 50 is arranged in a hollow section 42 or hollow section 43, the housing compartment 45 of which encases the packers 44, in which case the casing element 46 and housing compartment 45 which are evacuated as necessary adjoin the internal face of the hollow section 42 or the internal face 48 or internal side in the initial state. Naturally, if a metal material is used, the internal face or the external face of the hollow section 42 remote from it may be covered with an elastically resilient material.

Figure 4:
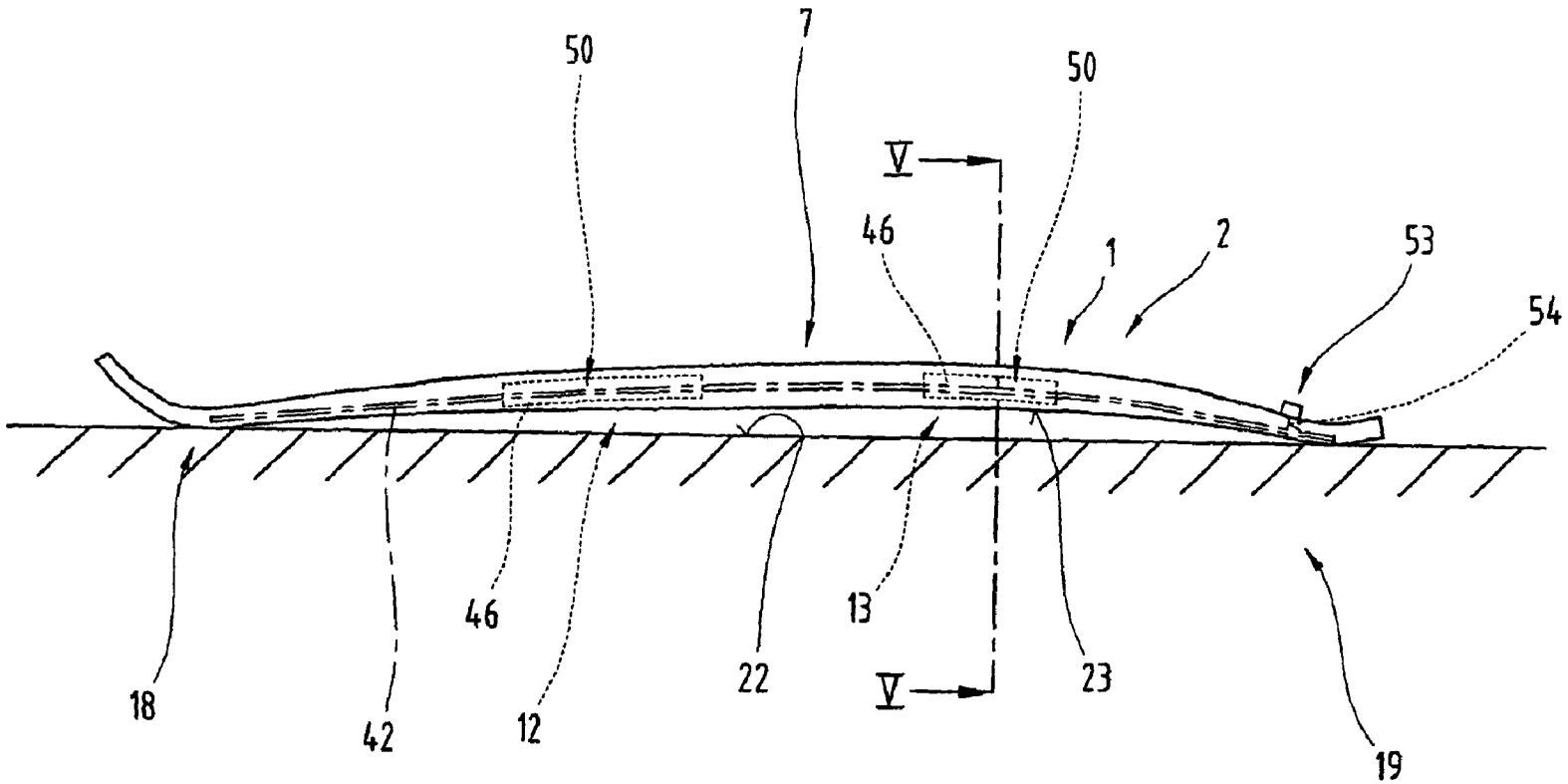
FIG. 4 is a highly simplified, schematic diagram of the runner device illustrated in FIG. 1, seen from a side view.
Figure 5:
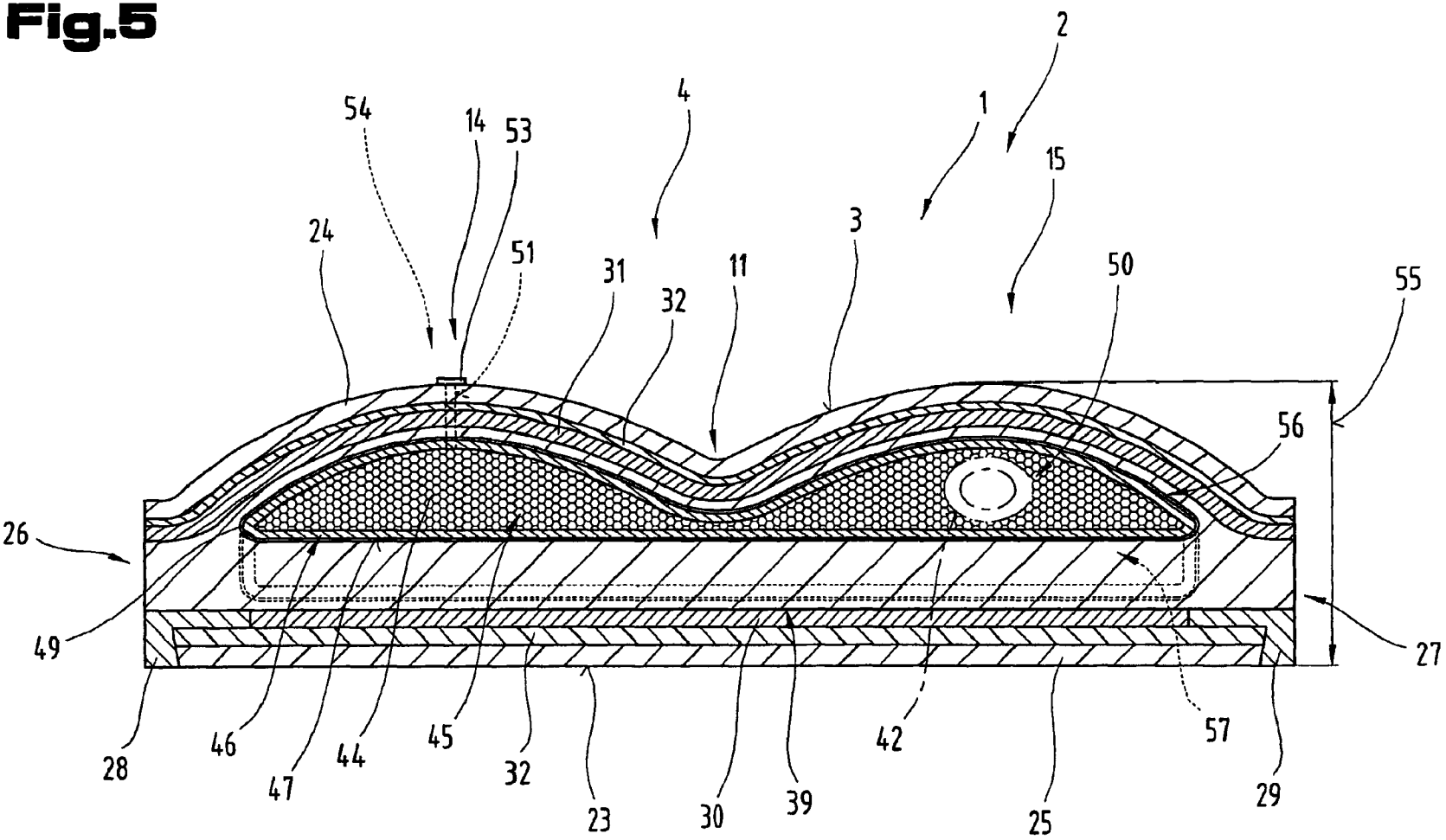
FIG. 5 is another embodiment of the stiffening and/or damping element seen in cross section, along line V—V indicated in FIG. 4.

In FIGS. 4 and 5 which will be described together, the runner device 1 is illustrated from different perspectives in a highly simplified diagrammatic form. As schematically illustrated in FIG. 4, the runner device 1 is provided with at least one stiffening and/or damping element 50, preferably with two housing compartments 45 adjacent to the middle region 7 and linked to one another. Accordingly, the stiffening and/or damping element 50 extends across at least a part of the length and/or width of the runner device 1. The planar stiffening and/or damping element 50 formed by the reinforcing element 12; 13 is preferably arranged in the core component 39 in a region lying closer to the top belt 31. The top face of the casing element 46 adjacent to the top belt 31 preferably extends parallel with the substantially congruently shaped top belt 31, whilst the base part arranged opposite it extends substantially parallel with the essentially planar bottom belt 30. The stiffening and/or damping element 50 is preferably disposed at a distance apart from the bottom belt 30 in the upper half of a half thickness 55 of the runner device 1. The casing element 46 filled with the packer 44 is preferably provided in the form of an elastically resilient deformable film enclosing the packer 44 on all sides. The housing compartment 45 of the stiffening and/or damping element 50 formed by the all-enclosing casing element 46 is in flow connection with the evacuation mechanism 52 (not illustrated), disposed on the top face 3 of the runner device 1, for example. It is provided in the form of a manually operable vacuum pump, which operates by pumping or sucking air out of the housing compartment 45 of the stiffening and/or damping element 50, thereby reducing the pressure inside the housing compartment 45 to a pressure below atmospheric pressure. From this evacuated state of the stiffening and/or damping element 50, the housing compartment 45 can be inflated again by providing the evacuating mechanism 52 with a manually operable return valve 53. The flow connection between the evacuating mechanism 52 and the housing compartment 45 is provided via a central inflating and/or deflating bore 51 and the supply line 54 in this embodiment, as illustrated. Naturally, it would also be possible to provide separate housing compartments 45 by providing oppositely lying webs extending transversely to the longitudinal extension of the runner device 1, which can be supplied respectively by means of at least one inflating and/or deflating bore 51. The housing compartments 45 could also be welded in certain regions.

In another embodiment, at least one hollow section 42 is provided in the housing compartment 45 of the stiffening and/or damping element 50 in order to improve deformation resistance, forming a reinforcing element on the one hand and the flow passage for the flow connection between the evacuating mechanism 52 and hosing compartment 45 on the other. Naturally, the casing element 46 may also be enclosed by a single- or multi-part hollow section, not illustrated, at least in certain regions, on which the stiffening and/or damping element 50 is supported in the initial state. Naturally, another possibility would be to provide the casing element 46 in several parts with at least one layer filling a cavity formed between the casing element 46 and the core component 39 which, in the evacuated state, will be elastically deformable in the direction of the core component 39 so that the individual components abut directly with one another and again form a positively joined stiffening element 50.

It should be pointed out that in all the embodiments, the distance between the casing element 46 and the core component 30 or hollow section 42; 43 which is formed in the evacuated state is essentially only a few tenths of a millimeter.

In another embodiment, in particular a snowboard, not illustrated, the runner device 1 has at least reinforcing elements 12, 13 or a stiffening and/or damping element 50 in the top layer 24 or between the top layer 24 and a running surface facing 25 in the longitudinal extension and in a direction disposed transversely thereto. By preference, several reinforcing elements 12 are spaced apart from one another transversely to the longitudinal direction of the snowboard. The longitudinally oriented reinforcing element 13 may be mounted in the same cross-sectional plane as the reinforcing element 12, and/or that above it and/or that below it. The reinforcing element 12; 13, which may optionally have the stiffening and/or damping element 50 can also be operated by means of an evacuating mechanism 52 and supply lines 54 and its housing compartments 45 evacuated as necessary. The way in which this operates was described in detail above.

The particular advantage of this embodiment is that because a plurality of reinforcing elements 12 is provided transversely to the longitudinal extension of the snowboard, ski or similar, partially differing degrees of hardness or deformation resistance can be achieved because every housing compartment 45 of the casing element 46 can be packed with different packers 44 if necessary.

The webs dividing the housing compartment 45 into several part-compartments may be arranged in the region of a half width of the stiffening and/or damping element 50, as measured transversely to the longitudinal extension of the runner device 1.

As may be seen from FIG. 4, the hollow section 42 extends across at least a part of the length of the runner device 1 or between two or more stiffening and/or damping elements 50 arranged one behind the other. In one advantageous embodiment, at least one stiffening and/or damping element 50 of a flat design is provided, the width and length of which extend across at least a part of the length and width of the runner device 1.

Naturally, it would also be possible to provide several flat stiffening and/or damping elements 50 arranged one on top of the other. This preferably square-shaped stiffening and/or damping element 50 is preferably made in a single piece from a resilient deformable film or covering 49, and the stiffening and/or damping element 50 may have several part-compartments separated from one another by dividing webs in the longitudinal direction thereof and/or in a direction disposed transversely and/or perpendicular thereto, and along the thickness 55 of the runner device 1. The stiffening and/or damping element 50, optionally comprising several layers 56 and 57, has a housing compartment 45 enclosed on all sides by the casing element 46 and its housing compartments 45 can be packed with packers 44 having the same and/or different properties. Naturally, the packer element 46 could also be made up of several layers of differing elasticity. A layer 56 and/or 57 may naturally also have several housing compartments 45.

The air-tight casing elements 46 could also be spaced apart from one another, in which case there will be several casing elements 46 in the core component 39 forming separate, dimensionally stable stiffening and/or damping elements 50 when the interior pressure in the casing element 46 is reduced to a pressure below atmospheric pressure.

The separate casing elements 46 may optionally be in flow communication with the evacuating mechanism 52 by means of two separate supply lines 54, enabling the housing compartments 45 of the casing elements 46 to be evacuated or vacuum or atmospheric pressure to be applied. The deformation stiffness of the runner device 1, in particular the bending, compression, torsional stiffness, etc., can be varied by means of the stiffening and/or damping elements 50, by adjusting the level of the vacuum pressure or by influencing the design or properties of the packers 44, in particular the degree of hardness and/or deformation properties, so that different running properties can be achieved to suit different application ranges or conditions of use.

Figure 6:
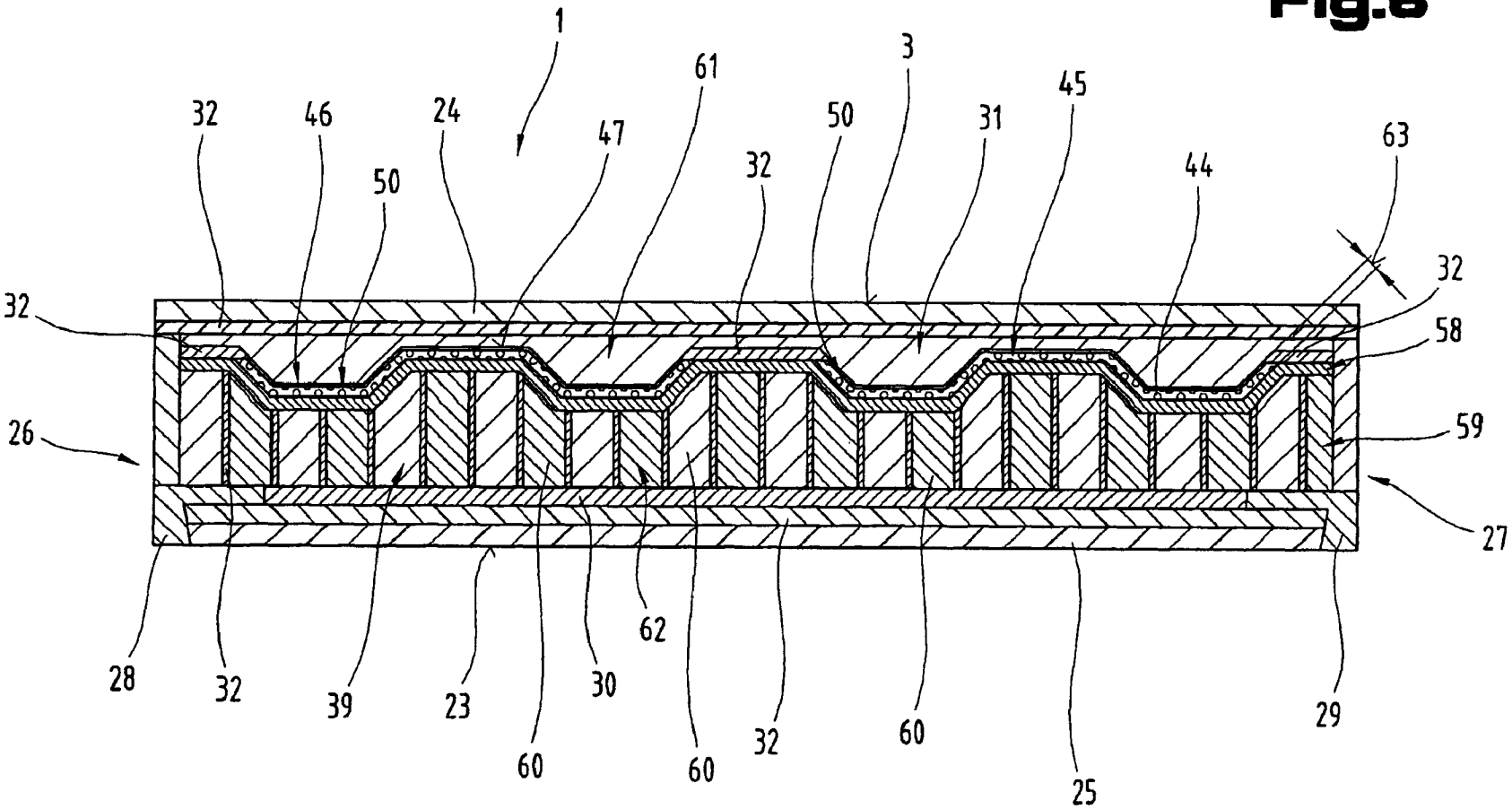
FIG. 6 is a highly simplified, schematic diagram showing another embodiment of the runner device and the stiffening and/or damping element, seen in cross section.

FIG. 6 illustrates another possible embodiment of the runner device 1 proposed by the invention. This diagram, showing a cross section, provides a particularly clear view of the layered structure and cross-sectional shapes of the individual components and elements of the runner device 1.

In a known manner, the outer peripheral zones of the runner device 1 are provided in the form of a top layer 24 forming the top face 3 and a running surface 23 lying opposite, forming the running surface facing 25. The substantially planar top layer 24 forms the top face 3 and optionally also the longitudinal side faces 26 and 27 of the runner device 1 extending perpendicular to the running surface 23. Steel edges 28, 29 provide a lateral boundary of the running surface 23. Between the top layer 24 and the running surface facing 25 are several plies or inlaid elements or layers, in particular at least one bottom belt 30 lying immediately adjacent to the running surface facing 25 and/or at least one top belt 31 lying immediately adjacent to the top layer 24, which are respectively joined thereto by means of a filler or adhesive layer 32. Several layers 58, 59 are preferably provided between the top belt 31 and the bottom belt 30, essentially forming the core component 39. The core component 39 consists of a plurality of schematically indicated strips 60 of wood, compressed and bonded to one another. The individual strips 60 are joined to one another by filler or adhesive layers 32, layers of size or synthetic resins. Naturally, the core component 39 could also be provided in the form of a sandwich component, consisting of different types of expanded foams, for example, or an appropriate aluminium construction or similar.

In the direction of the longitudinal extension of the runner device 1 and in the direction of the running surface 23, the top belt 31 has one, preferably several projections 61 spaced apart from one another transversely to the longitudinal direction of the runner device 1, with a trapezoidal cross-section, which stand up respectively in a recess 62 in one of the layers 58 or 59 aligned with the direction of the running surface 23. Naturally, the projections 61 and recesses 62 may be of any cross-sectional shape, for example rectangular, triangular, etc . . . The layer 58 may be made from all materials known from the prior art, such as plastics, glass fibre-reinforced plastics, composite plastics or metal materials, in particular aluminium, titanium or appropriate metal alloys or knitted fabric or textiles. Naturally, it would also be possible to provide only one projection 61 with a matching recess 62 between the top belt 31 and the layers 58, 59. A distance 63 measured between the side edges of the top belt 31 and the layer 58 is used to accommodate at least one stiffening and/or damping element 50 between them, the surface of the layer 58 directed towards top belt 31 or the surface of the top belt 31 remote from the top layer 24 forming a part of the casing element 46 enclosing the vacuum-tight housing compartment 45.

Projecting into this housing compartment 45 is at least one inflating and/or deflating bore 51 and supply line 54, not illustrated, which are in flow connection with the evacuating mechanism 52.

FIG. 6 provides a highly simplified, schematic illustration of the second evacuated state. The cavity formed between the casing element 46 and the surface of the top belt 31 in the evacuated state, which is illustrated on a disproportionately large scale, is packed with a covering of the top belt 31 and or by a separate, elastically resilient deformable layer, forming a positively connected stiffening element 50 between the top belt 31 and the layer 58.

The top belt 31 may be made from a coated aluminium pressed component or a cast aluminium component or an appropriate hard aluminium or steel insert, in which case the covering will be an elastically resilient, deformable material. It would also be possible for the top belt 31 or the casing element 46 to be of a multi-layered design, forming a separate, high-strength elastically resilient plastics component.

This permits no or only a very slight relative movement between the top belt 31 and the layer 58.

When the internal pressure in the casing element 46 is switched to atmospheric pressure, the slight distance or cavity between the casing element 46 of the stiffening and/or damping element 50 and the surface of the top belt 31 compensated by the elastic layer 38 of the top belt 31 is adjusted as the casing element 46 resumes shape.

When load is applied, as is the case during travel, relative displacements will occur between the top belt 31 and the layer 58 and the layer 59. This will impart a softer travel behaviour to the runner device 1.

As a result of the relative displacement between the top belt 31 and the layer 58 in the longitudinal direction of the runner device 1, a damping action between these two can also be achieved in a direction perpendicular to the running face 23 when load is applied if necessary, as a result of the damping element 50 formed by the casing element 46 and the packers 44. The degree of damping can be determined in particular by the elasticity of the packers 44.

FIGS. 7 to 11, which will be described together, provide highly simplified, schematic diagrams of another embodiment of the runner device 1 proposed by the invention in the longitudinal direction. The runner device 1, which is preferably of a multi-layered or multi-ply structure, consists of the top layer 24 forming the top face 3 and the running surface facing 25 forming running surface 23 arranged in the outer peripheral regions of the runner device 1. The top face 3 of the runner device 1 has a schematically illustrated mounting plate 64 for at least one binding part 65 in the binding mounting region 8 disposed between a binding 63 and the top face 3 of the runner device 1, which is connected to the runner device 1, in particular screwed thereto. In the embodiments described below, at least one stiffening and/or damping element 50 and a force and/or moment transmitting mechanism is provided on the top face 3 of the runner device 1 in a front part-region between the toe and the binding part 65 and/or in another oppositely lying end region of the runner device 1 between the toe and the binding part, not illustrated.

Figure 7:
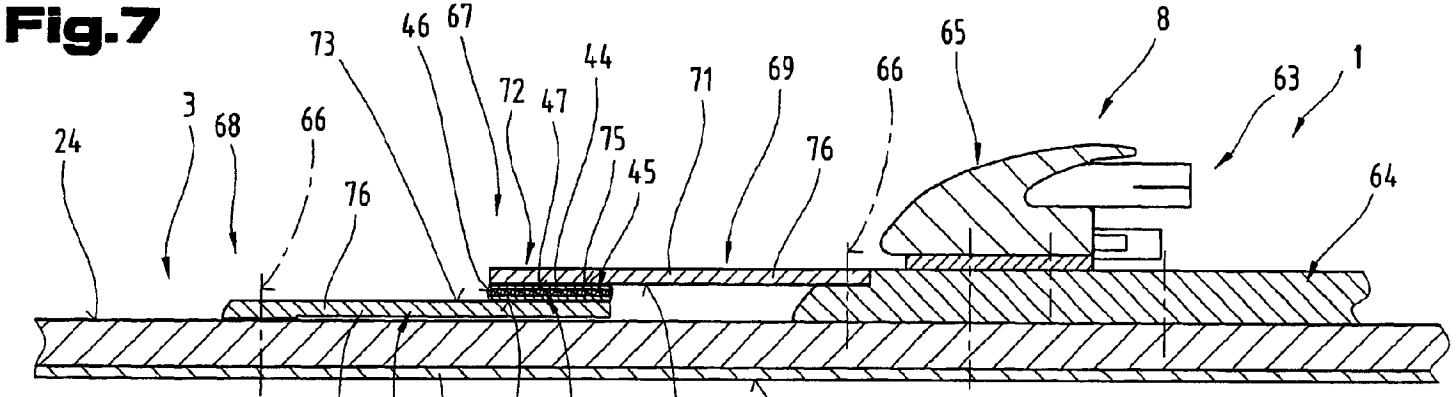
FIG. 7 is a highly simplified, schematic diagram of another embodiment of the runner device, with a mechanism arranged on the top face of the runner device, incorporating the stiffening and/or damping element proposed by the invention co-operating therewith, seen in longitudinal section.

As may be seen more clearly from FIG. 7, a force and/or moment transmitting mechanism 67 is provided in the front and/or rear part region of the runner device 1, in the longitudinal direction and or in a direction disposed transversely thereto, or several are provided spaced at a distance apart from one another in the direction of the length and./or in the direction of the width and are attached to the runner device 1 by fixing means 66. The mechanisms 67 may extend parallel with and/or at an angle to one another. The force and/or moment transmitting mechanism 67 is formed by at least two transmitting elements 69 arranged one above the other, optionally spaced at a distance apart, and overlapping with one another at least in end regions directed towards one another, between which the stiffening and/or damping element 50 proposed by the invention is arranged. One of the transmitting elements 69, preferably the transmitting element 69 adjacent to the top face 3, forms a thrust bearing 68 secured to the runner device 1 by the fixing means 66. The transmitting elements 69, which are expediently strip-shaped, in particular the plates 70, 71, are secured to the runner device 1 and/or the mounting plate 64 at their two opposing end regions remote from one another. The mechanism 67, in particular the transmitting elements 69, may be fixed using all fixing means 66 known from the prior art which will secure a form or positive fit connection, in particular screws, adhesives, etc. The stiffening and/or damping element or elements 50 proposed by the invention is or are arranged between the width-side faces 73 and 74, directed towards one another, of the transmitting elements 69 in an overlapping region 72 formed by the two transmitting elements 69 disposed one above the other.

The width-side faces 73 and 74 are joined by means of a filler or adhesive layer 75 to the casing element 46, which extends at least across a greater part of a width and across a smaller region of a length of the transmitting elements 69, packed with the packers 44, at least in certain regions. The airtight casing element 46 filled with the packers 44 is preferably provided in the form of an elastically resilient, deformable film or covering 47, which encloses the packers 44 on all sides. The housing compartment 45 of the stiffening and/or damping element 50 enclosed on all sides by the casing element 46 has a flow connection to the evacuating mechanism 52, which is provided on the top face 3 of the runner device 1, for example. It is manually operable by means of a vacuum pump, for example, which operates by pumping or sucking the air out of the housing compartment 45 of the stiffening and/or damping element 50, thus reducing the internal pressure in the housing compartment 45 to a pressure below atmospheric pressure. Naturally, it would also be possible for at least one of the transmitting elements 69 or the thrust bearing 68 to have a manually operable return valve 63, enabling an external vacuum pump to be connected if necessary.

As explained in more detail above, although not illustrated, the casing element 46 may optionally have different packers 44 forming several part-compartments, which are preferably in flow connection with a common supply line 54 and inflating and/or deflating bores 51. When the housing compartment 45 is placed in an evacuated state, the mutual compression or shrinking of the packers 44 inside the casing element 46 produces a stiffening element 50 to which tension or pressure can be applied, thereby enhancing the hardness and deformation resistance of the runner device 1.

The transmitting element 69 and thrust bearing 68 adjacent to the top face 3 are more or less L-shaped in cross section across their longitudinal extension, so that a space is formed between the top face 3 of the runner device 1 and the width-side surface of the longitudinally extending leg of the transmitting element 69, even when exposed to higher bending or compressive stress. The leg of the transmitting element 60 disposed perpendicular to the top face 3 has a bore with a fixing means 66 extending through it. The cross-sectional dimensions of the transmitting elements 69 and hence the length, width and thickness, as well as the length width and height of the stiffening and/or damping element 50, which correspond more or less to the distance between the width-side faces 73, 74 directed towards one another, may naturally be selected or optimised to cater for different types of stress.

When the internal pressure of the housing compartments 45 is adjusted to atmospheric pressure and compressive or bending stress occurs, the casing element 46 filled with packers 44 is able to absorb thrust forces between the transmitting elements 69 arranged one above the other. The transmitting elements 69 may naturally be of the same width as or shorter than the width of the runner device 1. Another possibility is to provide a mechanism 67 consisting of several strip-shaped transmitting elements 69 arranged one above the other, in which case their width will be a fraction of the width of the runner device 1.

For practical purposes, a respective mechanism 67 and the associated stiffening or damping element 50 may be arranged on the top face 3 of the runner device l,one adjacent to the longitudinal side walls 26, 27 and one between them at the half width of the runner device 1.

The transmitting elements 69 constituting the supporting elements 76 may naturally be made from all possible metal or non-metallic materials or plastics or composite materials known from the prior art, in particular sandwich components or prepregs.

Figure 8:
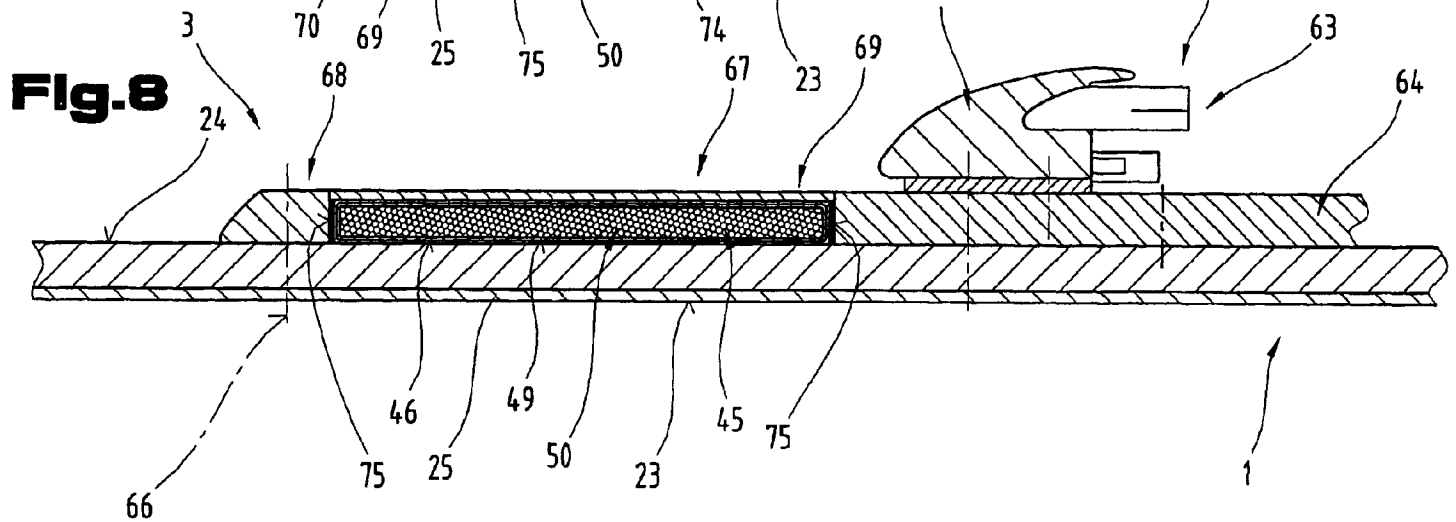
FIG. 8 is a highly simplified, schematic diagram of another embodiment of the runner device with a mechanism arranged on the top face of the runner device, incorporating the stiffening and/or damping element proposed by the invention co-operating therewith, seen in longitudinal section.

FIG. 8 illustrates another embodiment of the layout of the mechanism 67 made up of the thrust bearing 68 and the transmitting element or elements 69 and the co-operating stiffening and/or damping element 50, arranged between the square-shaped mounting plate 64 and a substantially strip-shaped thrust bearing 68 spaced at a distance apart from it in the longitudinal direction and joined to the runner device 1, the thrust bearing 68 extending in the direction of the width of the runner device 1. The associated stiffening and/or damping element or elements 50 associated with the top face 3 is or are preferably provided in the form of the planar, airtight, elastic casing element 46 packed with packers 44 and having one or more housing compartments 45. By preference, part-regions of the casing element 46 are joined to the mutually facing narrow side faces of the transmitting element 69 and the mounting plate by means of the filler or adhesive layer 75. The plate- or strip-shaped transmitting element 69 extending between a thrust bearing 68 and the mounting plate 64 encloses the flat casing element 46 on all sides. When the cavity produced between the top face 3 of the runner device 1 and the flat casing element 46 and the cavity produced between the width-side surface 73 of the transmitting element 69 and the casing element 46 may be compensated or packed by means of an additional elastically deformable covering 49 disposed on the covering 47 of the casing element 46, for example. In another design, the casing element 46 and/or the covering 49 and/or the thrust bearing 68 and the transmitting element 69 may be made from a transparent plastics material.

Figure 9:
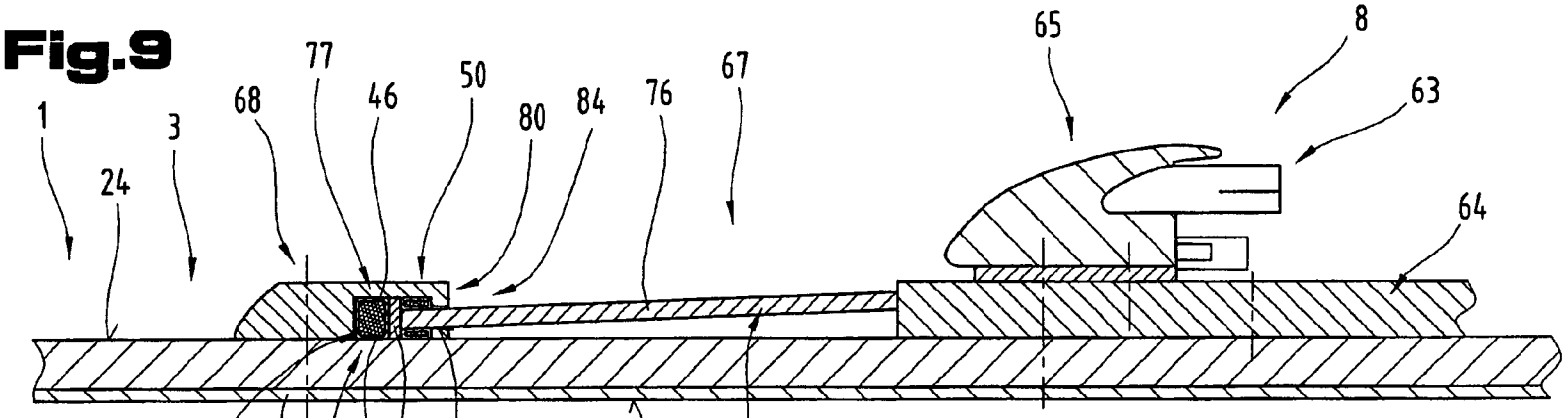
FIG. 9 is a highly simplified, schematic diagram of another embodiment of the runner device with a mechanism arranged on the top face of the runner device, incorporating the stiffening and/or damping element proposed by the invention co-operating therewith, seen in longitudinal section.

FIG. 9 illustrates another embodiment of the runner device 1 with the mechanism 67 and the stiffening and/or damping element 50 associated with it, as proposed by the invention. A transmitting element 69 in the form of a profiled supporting element 76 extends between the square-shaped mounting plate 64 and the thrust bearing 68 secured to the top face 3 at a distance apart. The longitudinally oriented transmitting element 69 runs at an angle to the top face 3 of the runner device 1 and a vertical distance between the top face 3 and the transmitting element 69 in the region of the mounting plate 64 is bigger than a vertical distance in the region of the thrust bearing 68. The essentially square-shaped thrust bearing 68 extends transversely to the longitudinal extension of the runner device 1. One of the end regions of the supporting element 76 is held or fixed in position by the mounting plate 64. The end region of the supporting element 76 lying opposite this end region projects into a recess 77 formed by the thrust bearing 68, in which one or more support elements 78 forming the stiffening and/or damping element 50 is disposed. A planar and in particular substantially rectangular plate element 79 is disposed end-on adjoining an end region of the supporting element 76 directed towards the stiffening and/or damping element 50. The front stiffening and/or damping element 50 facing the toe is provided as a square-shaped casing element 46, which is adjoined by a front face of the plate element 79. The end face directed towards the supporting element 76 adjoins and is supported on the other casing element 46 and stiffening and/or damping element 50.

The plate element 79 divides the recess 77 into two separate compartments, in which the casing elements 46 or stiffening and/or damping elements 50 are disposed, their covering 47 immediately adjoining the end faces of the plate element 79. The packers 44 of the two casing elements 46 may naturally have differing properties. Optionally, the casing element 46 may be joined to certain regions of the surface of the two compartments, in particular by adhesive, or they are merely inserted in the compartments, in which case they will be retained solely by the walls of the recess or compartments. In another embodiment, only one of the compartments has one or more casing elements 46.

A wall 80 of the transmitting element 68 facing the narrow side faces of the mounting plate 64 is fitted with a guide mechanism 81 accommodating a pivot transversely to the longitudinal extension of the runner device 1, which provides a slide bearing for the profiled supporting element 76 permitting a relative displacement between them. The supporting element 76 may be rounded, rectangular or square, etc., in cross section. Enclosed on all sides by the thrust bearing 68 and optionally by cladding plates spaced apart from one another by the width of the stiffening and/or damping element 50, the casing element 46 is joined in some regions to the recess 77 by means of the filler or adhesive layer 75. When the housing compartment 45 of the casing element 46 is evacuated, the packers 44 are pushed against one another, essentially rendering the body or stiffening element 50 dimensionally fixed or dimensionally stable. When, on the other hand, the housing compartment 45 is changed to atmospheric pressure, the elastic effect of the packers 44 permits a relative displacement between the supporting element 76 and the thrust bearing 68, thereby obtaining a damping action depending on the elasticity of the packers 44.

Figure 10:
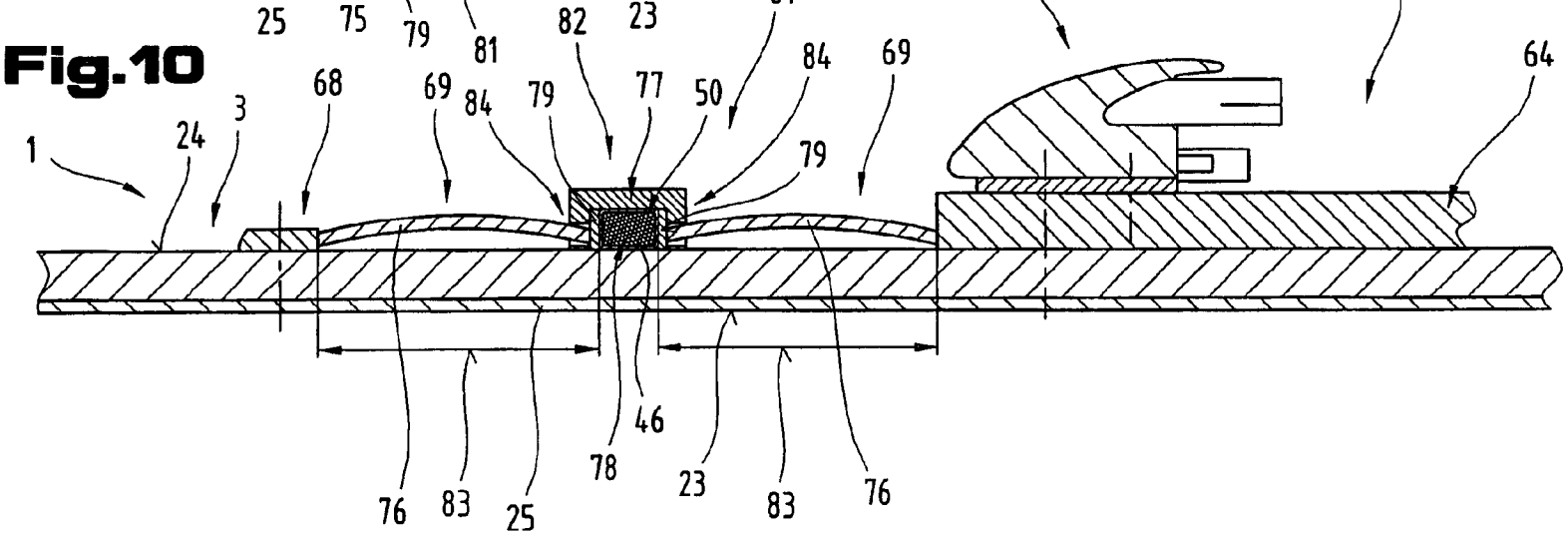
FIG. 10 is a highly simplified, schematic diagram of a different embodiment of the runner device with a mechanism arranged on the top face of the runner device, incorporating the stiffening and/or damping element proposed by the invention co-operating therewith, seen in longitudinal section.

FIG. 10 illustrates another embodiment of the mechanism 67 disposed in the region between the toe and the mounting plate 64 of the runner device 1 and comprising at least one thrust bearing 68 and several transmitting elements 69 in conjunction with the stiffening or damping element 50 proposed by the invention. Disposed in the longitudinal direction in the space between the thrust bearing 68 and the mounting plate 64 is at least one other transmitting element 82, one or more transmitting elements 69 or supporting elements 76 extending between the transmitting element 82 and the mounting plate 64 and the thrust bearing 68. In practical terms, the thrust bearing 68, which is substantially strip-shaped or has a rounded or oval cross section, and the substantially square transmitting element 82 and the mounting plate 64 extend across at least a large part of the width of the runner device 1. The stiffening and/or damping element 50 forming the supporting element 78 is disposed in the recess 77 of the transmitting element 82. A length of the transmitting element 69 is bounded by the stiffening and/or damping element 50 and the narrow side face of the mounting plate 64 facing it, so that a distance 83 between them in the longitudinal direction of the runner device 1 is shorter than a length of the transmitting element 69, so that the latter forms a curved, in particular slightly convex arcuate path relative to the top face 3 of the runner device 1. On its two oppositely lying narrow side walls remote from one another, the transmitting element 82 joined to the top layer 24 has a recess 84 with a cross section substantially matching that of the transmitting element 69, through which the transmitting elements 69 and supporting elements 76 project.

The curved transmitting elements 69 may naturally generate a certain degree of pre-tensioning between the stiffening and/or damping element 50 and the mounting plate 64 and the thrust bearing 68, so that they are supported by and abut with the covering 47 of the casing element 46 due to the arrangement of the end-side flat plate elements 79 of the two transmitting elements 69 facing the casing element 46.

The distance 83 between the casing element 46 of the narrow side face of the mounting plate 64 and the distance 83 between the casing element 46 and the narrow side face of the transmitting element 68 facing it are expediently the same. Naturally, the two distances 83 could also different. In another embodiment, not illustrated, the transmitting element 82 is disposed transversely to the longitudinal extension of the runner device 1, spaced at a vertical distance apart from the top face 3. The distance of the transmitting element 82 perpendicular to the top face 3 may be selected so that the transmitting elements 69 spaced around the stiffening and/or damping element 50 optionally form a convex arcuate path relative to the top face 3. With this embodiment, the casing element 46 may also be joined to a one-piece transmitting element 69 in the region of the square transmitting element 82, in which case the stiffening and/or damping element 50 permits a relative displacement thereof inside the recess 77 in the initial state. The transmitting element 82 spaced at a distance apart from the mounting plate 64 and from the thrust bearing 68 is preferably joined to certain regions of the runner device by several mutually spaced supporting webs aligned perpendicular to the top face 3. As explained in detail above, several mechanisms 67 may be provided across the width and/or length of the runner device 1, parallel with one another and/or one behind the other.

Figure 11:
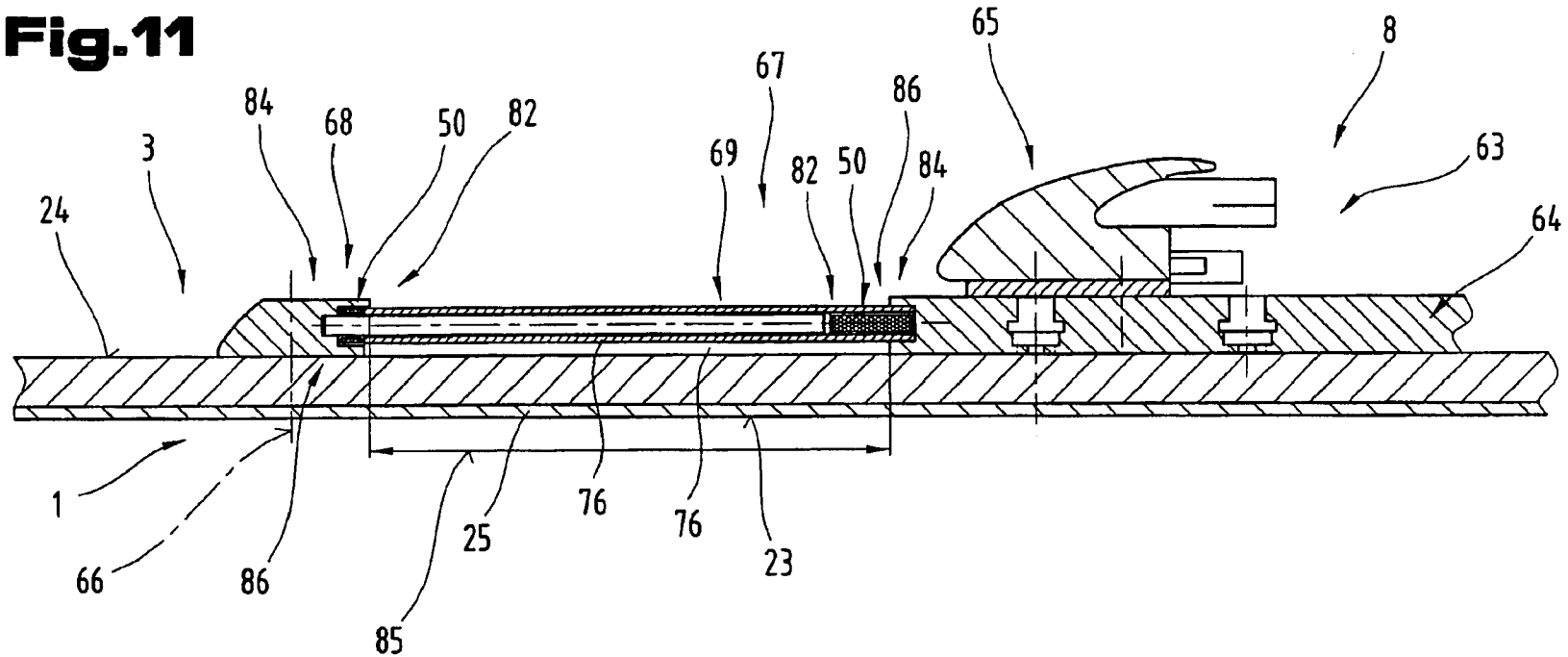
FIG. 11 simplified, schematic diagram of another embodiment of the runner device with a mechanism arranged on the top face of the runner device, incorporating the stiffening and/or damping element proposed by the invention co-operating therewith, seen in longitudinal section.

FIG. 11 illustrates another embodiment of the force and/or moment transmitting mechanism 67 with the stiffening and/or damping element 50, comprising the thrust bearing 68 and the transmitting element or elements 69. The transmitting element 69, which is preferably provided in the form of two tubular bearing elements 78 engaging in one another, extends between the mounting plate 64 and the square-shaped thrust bearing 68 arranged at a distance apart from it. The two supporting elements 76 are shorter in length than a distance 85 between the two mutually facing narrow end faces of the mounting plate 64 and the thrust bearing 68, so that the supporting elements 76 overlap in certain regions only. A preferably cylindrically shaped cavity 86 is formed in an end region of the transmitting element 69 adjacent to the mounting plate 64, between the two supporting elements 76 engaging with one another, in which the casing element 46 and the stiffening and/or damping element 50 is disposed. The outer supporting element 76 is preferably a hollow section, which may have a rounded or polygonal cross section. The supporting element 76 lying inside expediently has a continuous cross section, the end region thereof facing the mounting plate 64 co-operating with the stiffening and/or damping element 50. The cylindrical cavity 86 adjacent to the mounting plate 64 and the annular cavity 86 thereof formed in the oppositely lying region of the transmitting element 69 borders on the outwardly lying supporting element 76 and the wall of the thrust bearing 69, in which the casing element 46 is arranged. The stiffening and/or damping element 50 and casing element 46 are disposed in the cavities 86 at either side opposite the end regions of the supporting elements 76 and can be packed with packers 44 of differing properties.

The supporting elements 76, retained in the mounting plate 64 by their end regions and fixedly retained in the transmitting element 64 are spaced at a distance apart from the top face 3 of the runner device 1 so that it does not come into contact with the top face 3 when subjected to a predeterminable maximum bending or compression stress.

The supporting elements 76 are made from an elastically resilient material, with a bending characteristic corresponding to the bending characteristic of the runner device 1 on exposure to tensile or compressive load. The covering 47 of the casing element 46 may naturally be joined to an internal face of the supporting elements 76 facing the covering 47, at least in certain regions. The casing element 46 surrounding all sides of the cavity 86 in the top face may naturally be left loose.

The housing compartments 45 of the two oppositely lying casing elements 46 may be in flow connection by means of a common supply line 54, not illustrated, or each casing element 46 may have its own supply line 54. Accordingly, a vacuum will be generated in only one casing element 46, for example, enabling a different hardness or deformation property to be obtained across several part-regions of the runner device 1.

Naturally, in all the embodiments illustrated in FIGS. 7 to 11, the transmitting element 69 may be joined to the top layer 24 or top face 3 of the runner device 1 directly or by a fixing mechanism, not illustrated. This fixing mechanism may be arranged at a distance apart from the mounting plate 64. The fixing mechanism may be a square-shaped bearing element, for example, which holds the transmitting element 69 and the supporting element 76 in position.

For the sake of good order, it should be pointed out that in order to provide a clearer understanding, the runner device and its component parts are illustrated to a certain degree out of scale and/or on an enlarged scale and/or on a reduced scale.

The independent solutions proposed by the invention as a means of achieving the objective may be found in the description.

Above all, the embodiments and features illustrated in FIGS. 1, 2; 3; 4, 5; 6; 7, 8, 9, 10, 11 may be construed as independent solutions proposed by the invention. The associated objectives and solutions may be found in the detailed descriptions of these drawings.

List of reference numbers

| | |
|---|---|
| 1 | Runner device |
| 2 | Ski |
| 3 | Top face |
| 4 | Profiled region |
| 5 | End region |
| 6 | End region |
| 7 | Middle region |
| 8 | Binding mounting region |
| 9 | Strip |
| 10 | Strip |
| 11 | Recess |

-continued

| List of reference numbers |
|---|
| 12 Reinforcing element |
| 13 Reinforcing element |
| 14 Raised area |
| 15 Raised area |
| 16 Viewing window |
| 17 Cutout |
| 18 Contact zone |
| 19 Contact zone |
| 20 Contact region |
| 21 Contact region |
| 22 Ground |
| 23 Running surface |
| 24 Top layer |
| 25 Running surface lining |
| 26 Longitudinal side wall |
| 27 Longitudinal side wall |
| 28 Steel edge |
| 29 Steele edge |
| 30 Bottom belt |
| 31 Top belt |
| 32 Filler or adhesive layer |
| 33 Anchoring projection |
| 34 Anchoring projection |
| 35 Longitudinal side edge |
| 36 Longitudinal side edge |
| 37 Longitudinal side edge |
| 38 Distance |
| 39 Core component |
| 40 Filler material |
| 41 Expanded foam core |
| 42 Hollow section |
| 43 Hollow section |
| 44 Filler body |
| 45 Housing compartment |
| 46 Casing element |
| 47 Covering |
| 48 Internal face |
| 49 Covering |
| 50 Stiffening and/or damping element |
| 51 Inflating and/or deflating bore |
| 52 Evacuation mechanism |
| 53 Back flow valve |
| 54 Supply line |
| 55 Thickness |
| 56 Layer |
| 57 Layer |
| 58 Layer |
| 59 Layer |
| 60 Strip |
| 61 Projection |
| 62 Recess |
| 63 Binding |
| 64 Mounting plate |
| 65 Binding part |
| 66 Fixing means |
| 67 Mechanism |
| 68 Thrust bearing |
| 69 Transmitting element |
| 70 Plate |
| 71 Plate |
| 72 Overlap region |
| 73 Width-side surface |
| 74 Width-side surface |
| 75 Filler or adhesive layer |
| 76 Supporting element |
| 77 Recess |
| 78 Bearing element |
| 79 Plate element |
| 80 Wall |
| 81 Guide mechanism |
| 82 Transmitting element |
| 83 Distance |
| 84 Recess |
| 85 Distance |
| 86 Cavity |

What is claimed is:

1. A runner device comprising (a) a stiffening and/or damping element extending over at least a portion of the length and width of the runner device for absorbing and counterbalancing external forces to which the runner device may be subjected, the stiffening and/or damping element consisting of (1) an elastically deformable casing element formed by at least one covering layer, the casing element enclosing a housing compartment having an evacuatable interior chamber which is filled with filler bodies and has a vent, (b) an evacuation mechanism, and (c) a supply line for connecting the evacuation mechanism to the vent for changing the air pressure in the interior chamber whereby the hardness and resistance to deformation of the stiffening and/or damping element is adjustable.

2. Runner device as claimed in claim 1, wherein the runner device comprises more than one stiffening and/or damping element spaced apart from one another in the longitudinal direction and/or in a direction disposed transversely thereto and/or in a direction of a thickness.

3. Runner device as claimed in claim 1, wherein the casing element has several covering layers with differing elasticities or deformation properties.

4. Runner device as claimed in claim 1, wherein the housing compartment has several part-compartments separated from one another by elastically deformable webs.

5. Runner device as claimed in claim 1, wherein housing compartments of several of said casing elements or part-compartments thereof are in flow communication.

6. Runner device as claimed in claim 1, wherein part regions of the casing element are provided in the form of a profiled reinforcing element and/or a flat layer and/or a top or bottom belt.

7. Runner device as claimed in claim 1, wherein the casing element is disposed in a tubular or profiled reinforcing element.

8. Runner device as claimed in claim 7, wherein the reinforcing element is a hollow section extending at least across a large part of the length of the runner device.

9. Runner device as claimed in claim 8, wherein the casing element or elements are arranged in a hollow cross section formed between several hollow sections.

10. Runner device as claimed in claim 8, wherein the hollow section forms the supply line which is connected to the evacuating mechanism.

11. Runner device as claimed in claim 1, wherein the casing element has one or more reinforcing elements in the housing compartment.

12. Runner device as claimed in claim 1, wherein the casing element is disposed between two or more layers or coverings of a multi-layered runner device.

13. Runner device as claimed in claim 12, wherein the casing element is disposed closer to a top layer.

14. Runner device as claimed in claim 1, wherein the housing compartment is in flow communication with the evacuating mechanism via a return valve.

15. Runner device as claimed in claim 1, wherein the runner device comprises a connector fitting for an external vacuum pump.

16. Runner device as claimed in claim 1, wherein the filler bodies are spherical in shape.

17. Runner device as claimed in claim 1, wherein the filler bodies are made from a hard material.

18. Runner device as claimed in claim 1, wherein the filler bodies are made from open-cell plastics spheres.

19. Runner device as claimed in claim 1, wherein the filler bodies have a core of hard material, which is covered with an elastic material.

20. Runner device as claimed in claim 1, wherein the filler bodies are made from different materials and are of different sizes.

21. Runner device as claimed in claim 1, wherein at least one mechanism having at least one stiffening and/or damping element co-operating therewith is disposed in the longitudinal direction and/or in a direction disposed transversely thereto on a layer forming the top face of the runner device.

22. Runner device as claimed in claim 21, wherein the mechanism has at least one strip-shaped or square or profiled transmitting element forming a supporting element.

23. Runner device as claimed in claim 22, wherein the profiled transmitting element is a hollow section with a rounded or oval or polygonal cross section.

24. Runner device as claimed in claim 22, wherein at least one thrust bearing is arranged at a distance apart from a mounting plate for at least one binding part or from a separate fixing mechanism, and the transmitting element extends between them.

25. Runner device as claimed in claim 24, wherein an end-side region of the transmitting element is held in position on the mounting plate or the fixing mechanism and the other end-side region is mounted so as to be displaceable relative to the thrust bearing.

26. Runner device as claimed in claim 24, wherein the transmitting element is made up of several supporting elements engaging one inside the other or overlapping with one another at least in certain regions, of which an outer hollow section is held in position at its two opposing ends region by the mounting plate or fixing mechanism and the thrust bearing, whilst an inner of the supporting elements is held in position by the thrust bearing.

27. Runner device as claimed in claim 26, wherein at one of the end regions of the transmitting element a cavity is formed by the supporting elements engaging in one another and/or a wall of the thrust bearing or the mounting plate or the fixing mechanism, in which the housing compartments of stiffening and/or damping elements are disposed.

28. Runner device as claimed in claim 24, wherein at least one other transmitting element, which may optionally be joined to the top face, is provided between the mounting plate or a separate fixing mechanism and the thrust bearing spaced at a distance therefrom.

29. Runner device as claimed in claim 28, wherein the stiffening and/or damping element is disposed between mutually facing end-side end regions of the transmitting element.

30. Runner device as claimed in claim 28, wherein a length of the transmitting element is longer than a distance in the longitudinal direction of the runner device between the mounting plate or the fixing mechanism and the other transmitting element.

31. Runner device as claimed in claim 22, wherein the transmitting element forms a curved arc on the top face.

32. Runner device as claimed in claim 1, comprising a thrust bearing and/or a transmitting element having a recess to accommodate at least one stiffening and/or damping element.

33. Runner device as claimed in claim 32, wherein the end region of a supporting element projecting into the recess is guided in a longitudinally sliding or pivoting arrangement by a guide mechanism formed by the thrust bearing.

34. Runner device as claimed in claim 33, wherein one end of the transmitting element has a substantially strip-shaped plate element adjoining the housing compartment of the stiffening and/or damping element.

35. Runner device as claimed in claim 32, wherein a plate element divides the recess into several compartments, in which at least one stiffening and/or damping element and casing element with the same or different filler bodies are disposed.

36. Runner device as claimed in claim 1, wherein the runner device comprises a running surface lining and a top layer, the stiffening and/or damping element being disposed therebetween.

37. Runner device as claimed in claim 1, wherein the runner device comprises a top layer and the stiffening and/or damping device is mounted on the top layer.

* * * * *